US011389934B2

(12) United States Patent
Lee

(10) Patent No.: US 11,389,934 B2
(45) Date of Patent: Jul. 19, 2022

(54) ATTACHMENT ASSEMBLY TO BE CONNECTED WITH A HAND TOOL

(71) Applicant: Chih-Ming Lee, Taichung (TW)

(72) Inventor: Chih-Ming Lee, Taichung (TW)

( * ) Notice: Subject to any disclaimer, the term of this patent is extended or adjusted under 35 U.S.C. 154(b) by 442 days.

(21) Appl. No.: 16/673,954

(22) Filed: Nov. 4, 2019

(65) Prior Publication Data

US 2020/0070322 A1 Mar. 5, 2020

Related U.S. Application Data

(63) Continuation-in-part of application No. 15/851,740, filed on Dec. 21, 2017, now abandoned.

(51) Int. Cl.

| | |
|---|---|
| ***B25B 23/00*** | (2006.01) |
| ***B25B 13/46*** | (2006.01) |
| *B25B 13/48* | (2006.01) |

(52) U.S. Cl.

CPC ..... *B25B 23/0021* (2013.01); *B25B 23/0028* (2013.01); *B25B 13/467* (2013.01); *B25B 13/481* (2013.01)

(58) Field of Classification Search

CPC ..... B25B 23/0021; B25B 23/0028; B25B 23/0007; B25B 13/467; B25B 13/463; B25B 13/481; B25B 17/00; B25B 17/02; B25G 1/002; B25G 1/005

USPC ..... 81/57.3, 177.2, 177.85, 177.8, 177.9

See application file for complete search history.

(56) References Cited

U.S. PATENT DOCUMENTS

| | | | | |
|---|---|---|---|---|
| 6,923,094 | B1 * | 8/2005 | Marquardt | B25B 13/481 81/177.8 |
| 7,703,356 | B2 * | 4/2010 | Bass | B25B 17/00 81/177.8 |
| 8,960,056 | B2 * | 2/2015 | Lee | B25B 13/461 81/177.8 |
| 10,099,350 | B2 * | 10/2018 | Gates | B25B 17/00 |

* cited by examiner

*Primary Examiner* — Anne M Kozak
*Assistant Examiner* — Makena S Markman

(57) ABSTRACT

An attachment assembly for being connected with a hand tool includes an active unit, a passive unit and a switching shaft. The active unit includes a front wheel, a middle wheel and a rear wheel are simultaneously rotatably connected in sequence. The passive unit includes a first wheel and a second wheel are simultaneously rotatably connected. The switching shaft pivotably connects the active unit and the passive unit, and switches the active unit and the passive unit being rotatable or not.

12 Claims, 13 Drawing Sheets

ATTACHMENT ASSEMBLY TO BE CONNECTED WITH A HAND TOOL

The present invention is a Continuation-In-Part application of applicant's former application with the application Ser. No. 15/851,740, filed on Dec. 21, 2017.

BACKGROUND OF THE INVENTION

1. Fields of the Invention

2. Descriptions of Related Art

A conventional transmission tool, such as U.S. Pat. No. 7,703,356, includes three body groups 40*a*/40*b*/40*c* that are sequentially pivotally connected. Each body group 40*a*/40*b*/40*c* includes a body 42, a cover 43, a plurality of joints 45, and a first ratchet wheel 52, a second ratchet wheel 54 and a third ratchet wheel 56. The bottom of the first receiving groove 46 defined in the body 42 is provided with hole-shaped a first pivoting portion 47*b*, a second pivoting portion and a third pivoting portion 49*b*. A curved surface-shaped locking portion 48 is defined on the outer circumference of one end of the body 42. The locking portion 48 is provided with first engaging teeth 62. The first ratchet wheel 52, the second ratchet wheel 54 and the third ratchet wheel 56 are pivotally disposed in the first pocket 46. Each cover 43 is movably assembled with an arc-shaped restrict member 60 which has second engaging teeth 61 for switching to engage with the first engaging teeth 62 or not to control the body group 40*b* to rotate with respect to body groups 40*a*/40*c* or not. However, the prior patent has disadvantages: (1) The restrict member 60 is exposed on the outside of each body group 40*a*/40*b*/40*c*, which is not only unsightly, but also easily touched during operation, so that the second engaging teeth 61 and the first engaging teeth 62 accidentally disengaged, and so that the two body groups are arbitrarily rotated to cause inconvenience; (2) The second engaging teeth 61 and the first engaging teeth 62 have a small number of meshing teeth (8 teeth at most), so that the meshing rigidity is not good; and (3) The first engaging teeth 62 of the locking portion 48 is exposed outside the body 42 and is not aesthetically pleasing.

The present invention intends to provide an attachment unit for being connected with a hand tool so as to transfer large torque to objects.

SUMMARY OF THE INVENTION

The present invention relates to an attachment assembly for being connected with a hand tool, and comprises an active unit, a passive unit and a switching shaft. The active unit includes a first base and a first cover. A front wheel, a middle wheel and a rear wheel are rotatably received in a space between the first base and the first cover in sequence. The front, middle and rear wheels are engaged with each other. The passive unit includes a second base and a second cover. A first wheel and a second wheel are rotatably received in a space between the second base and the second cover. The first and second wheels are engaged with each other. The switching shaft pivotably connects the active unit and the passive unit which is pivotably connected to the active unit. The switching shaft switches the active unit and the passive unit being rotatable or not.

The primary object of the present invention is to provide an attachment assembly for being connected with a hand tool, wherein the active and passive units are pivotable relative to each other. The engagement between the front, rear, middle, first and second wheels provides features for different work tasks.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
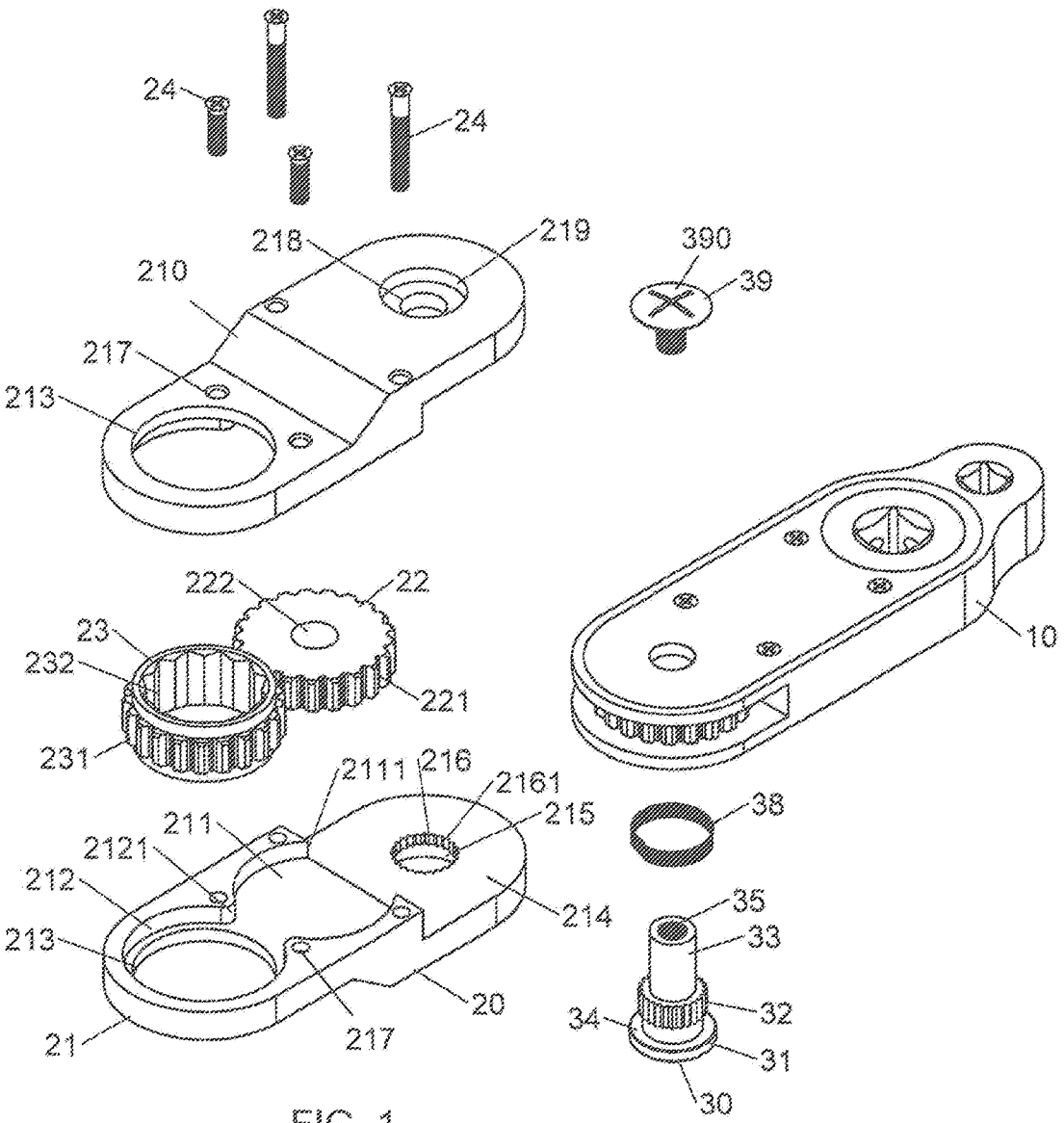
FIG. 1 is an exploded view of the attachment assembly of the present invention.

Referring to FIGS. 1 to 6, the attachment assembly of the present invention comprises an active unit 10, a passive unit 20 and a switching shaft 30.

The active unit 10 comprises a first base 11 and a first cover 15 which is mounted to the first base 11. Each of the first base 11 and the first cover 15 has a front end and a rear end. A front wheel 12, a middle wheel 14 and a rear wheel 13 are rotatably received in the space between the first base 11 and the first cover 15 in sequence. The first base 11 has a front recess 111, a middle recess 112 and a rear recess 113. The front recess 111 has a front pivotal hole 1111 defined through the bottom thereof. A first opening 1121 is defined in communication between the front and middle recesses 111, 112. The rear recess 113 opens to the rear end of the first base 11. A second opening 1131 is defined in communication between the middle and rear recesses 112, 113. The rear recess 113 has a rear pivotal hole 1132 defined through the bottom thereof. A lateral slot 1130 defined from a lateral wall of the rear recess 113 and through a rear end of the first base 11. Multiple first engaging teeth 11320 are defined on the inner periphery of the rear pivotal hole 1132. A first mounting hole 114 is defined through the front end of the first base 11 such that the front recess 111 is located between the first mounting hole 114 and the middle recess 112. The first base 11 includes four even-spaced locking holes 115. In one preferred embodiment, the number of the multiple first engaging teeth 11320, the multiple second engaging teeth 2161 and the multiple third engaging teeth 32 are 10~20 respectively.

The front wheel 12, the middle wheel 14 and the rear wheel 13 are respectively and rotatably received in the front recess 111, the middle recess 112 and the rear recess 113. The front wheel 12, the middle wheel 14 and the rear wheel 13 have the same diameter. Each of the front wheel 12, the middle wheel 14 and the rear wheel 13 has teeth 121/131/141 defined in an outside thereof. A polygonal engaging portion 122 is defined centrally in the front wheel 12 for connecting a workpiece. The teeth 121 of the front wheel 12 are engaged with the teeth 141 of the middle wheel 14 via the first opening 1121. The teeth 141 of the middle wheel 14 are engaged with the teeth 131 of the rear wheel 13 via the second opening 1131. The rear wheel 13 has an axial hole 132 defined centrally therethrough. An enlarged receiving hole 133 is defined in the bottom portion of the axial hole 132 so that the inner diameter of the enlarged receiving hole 133 is larger than that of the axial hole 132. The middle wheel 14 includes a first receiving portion 142 and an annular groove 143 located around the first receiving portion 142. A ring-shaped resilient member 144 is engaged with the annular groove 143.

The first cover 15 has two bores 151, 152 respectively located close to the front end and the rear end of the first cover 15. The two bores 151, 152 are respectively located corresponding to the front recess 111 and the rear recess 113. The front wheel 12 is rotatably engaged between the front pivotal hole 1111 and the bore 151 located close to the front end of the first cover 15. The engaging portion 122 and the axial hole 132 are respectively exposed. The rear wheel 13 is rotatably engaged between the rear pivotal hole 1132 and the bore 152 located close to the rear end of the first cover 15. The first base 11 and the first cover 15 each have even-spaced locking holes 115, 155. Multiple rivets 16 are riveted through the locking holes 115, 155 to connect the first base 11 and the first cover 15. The first cover 15 covers up the middle wheel 14. The ring-shaped resilient member 144 is engaged with the annular groove 143 and contacts the first cover 15 so that when the middle wheel 14 is rotated, a damper is generated by the ring-shaped resilient member 144.

The passive unit 20 includes a second base 21 and a second cover 210 which is mounted to the second base 21. A first wheel 22 and a second wheel 23 are rotatably received in the space between the second base 21 and the second cover 210. The teeth 221 of the first wheel 22 is engaged with teeth 231 of the second wheel 23 and teeth 131 of the rear wheel 13.

The second base 21 has a recessed area 214, a first recess 211 and a second recess 212 defined therein. A third opening 2111 is defined in communication between the recessed area 214 and the first recess 211. The second recess 212 has a third bore 213 defined through the bottom thereof. The inner diameter of the second recess 212 is larger than that of the third bore 213. A fourth opening 2121 is defined in communication between the first recess 211 and the second recess 212. The rear end of the active unit 10 is rotatably located in the recessed area 214. The rear recess 113 of the active unit 10 communicates with the first recess 211 via the third opening 2111. The first wheel 22 has a circular second receiving portion 222, and the second wheel 23 has a polygonal engaging portion 232 defined axially therethrough for engaging with a workpiece or a tool bit. The recessed area 214 has a first bore 216 defined through the bottom thereof. An enlarged circular recess 215 is defined in the bottom portion of the first bore 216 so that the inner diameter of the enlarged circular recess 215 is larger than that of the first bore 216. Multiple second engaging teeth 2161 are defined on inner periphery of the first bore 216. The second cover 210 has a second bore 218 corresponding to the first bore 216 of the second base 21. An enlarged circular recess 219 is defined in the top portion of the second bore 218. The first and second wheels 22, 23 are respectively and rotatably received in the first and second recesses 211, 212. The outer teeth 221 of the first wheel 22 are engaged with the outer teeth 231 of the second wheel 23 via the fourth opening 2121 so that the first wheel 22 and the second wheel 23 can be rotated simultaneously. The outer teeth of the first wheel 22 are engaged with the outer teeth 131 of the rear wheel 13 via the third opening 2111 and lateral slot 1130 so that the first wheel 22 and the rear wheel 13 can be rotated simultaneously. Two ends of the second wheel 23 is rotatably engaged between the third bore 213 of the second recess 212 and another third bore 213 of the second cover 210. Multiple rivets 24 extend through the locking holes 217 to connect the second cover 210 to the second base 21. The second cover 210 is the same shape as the second base 21 but only the second bore 218 of the second cover 210 has no the multiple second engaging teeth 2161 of the first bore 216.

A switching shaft 30 movably extends through the first bore 216 of the recessed area 214, the rear pivotal hole 1132 of the first base 11, the axial hole 132 of the rear wheel 13 and the second bore 218 of the second cover 210. A spring 38 sleeves on the switching shaft 30 for providing an elastic force for the switching shaft 30 so that the switching shaft 30 can axially move back from a second position to a first position. A cylinder body 33 is defined at a top portion of the switching shaft 30. The cylinder body 33 pivots through the axial hole 132 of the rear wheel 13 and the second bore 218 of the second cover 210, so that the active unit 10 and the passive unit 20 are pivotable about the switching shaft 30 to adjust the inclined angle between the active unit 10 and the passive unit 20. The switching shaft 30 has a head 31 defined on the bottom end thereof, and multiple third engaging teeth 32 are surrounding defined on a middle portion of the switching shaft 30 for engaging with the second engaging teeth 2161 and/or the first engaging teeth 11320. A screwed hole 35 is defined on top end of the switching shaft 30 for connecting with a screw 39. The outer diameter of the head 31 is larger than that of the third engaging teeth 32. The outer diameter of the third engaging teeth 32 is larger than that of cylinder body 33. The head 31 of the switching shaft 30 and the head 390 of the screw 39 are respectively received in the enlarged recess 215 of the second base 21 and the enlarged recess 219 of the second base 21, and the end faces 34/391 of the heads 31/390 are respectively restricted by the corresponding bottoms of the enlarge recesses 215/219 so as to restrict the switching shaft 30 from dropping from the bores 216/218 and the axial hole 132.

Figure 7:
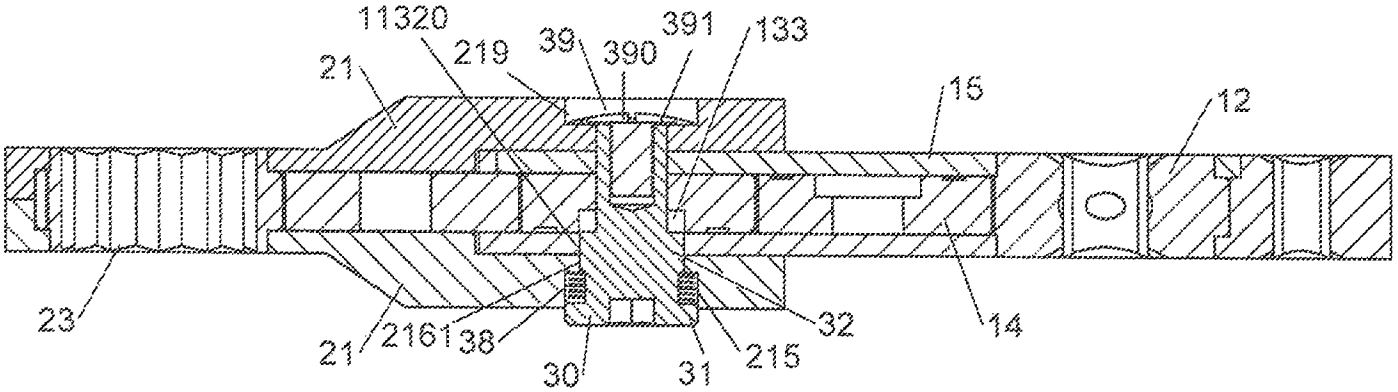
FIG. 7 shows is a cross sectional view, taken along line B-B of FIG. 6 to show the switching shaft being positioned at first position.
Figure 8:
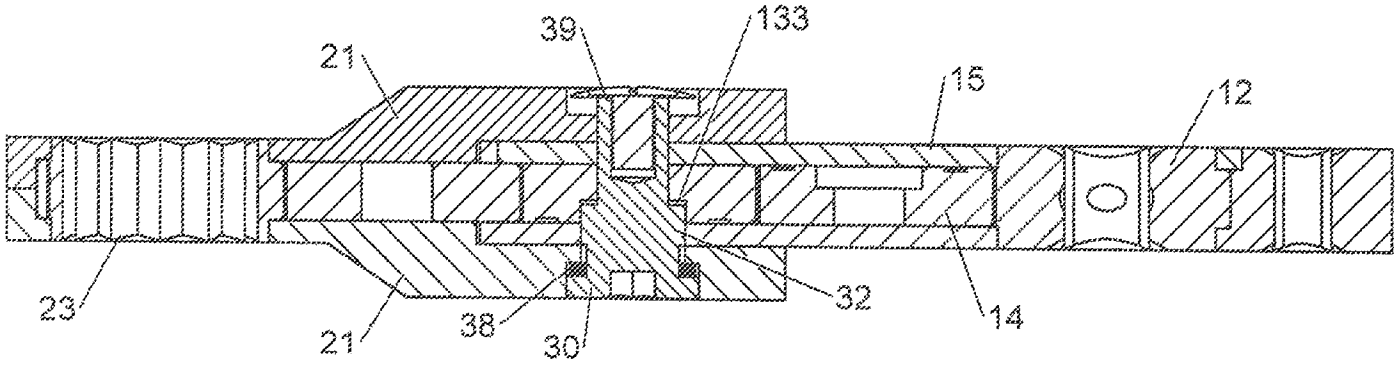
FIG. 8 shows is a cross sectional view, taken along line B-B of FIG. 6 to show the switching shaft being positioned at second position.
Figure 9:
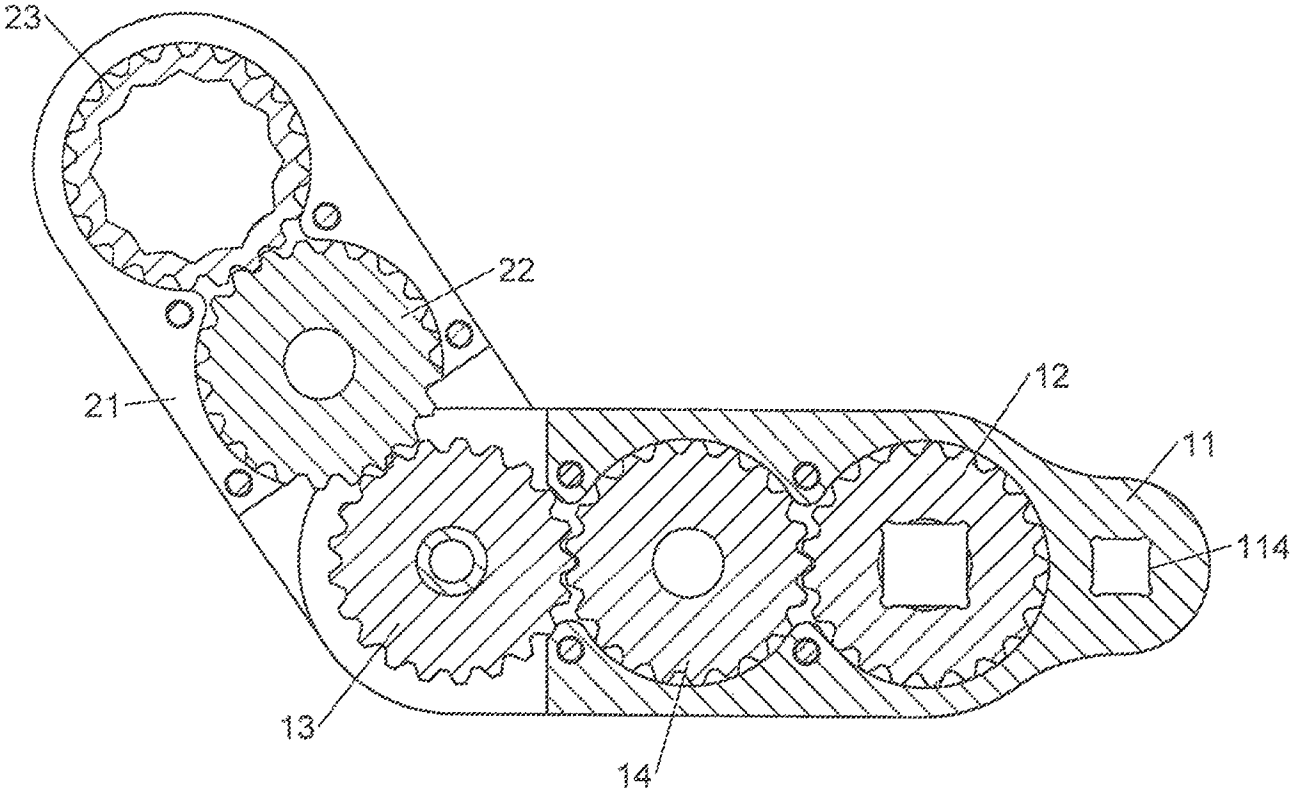
FIG. 9 shows the active unit and the passive unit of the attachment assembly of the present invention having an inclined angle.
Figure 14:
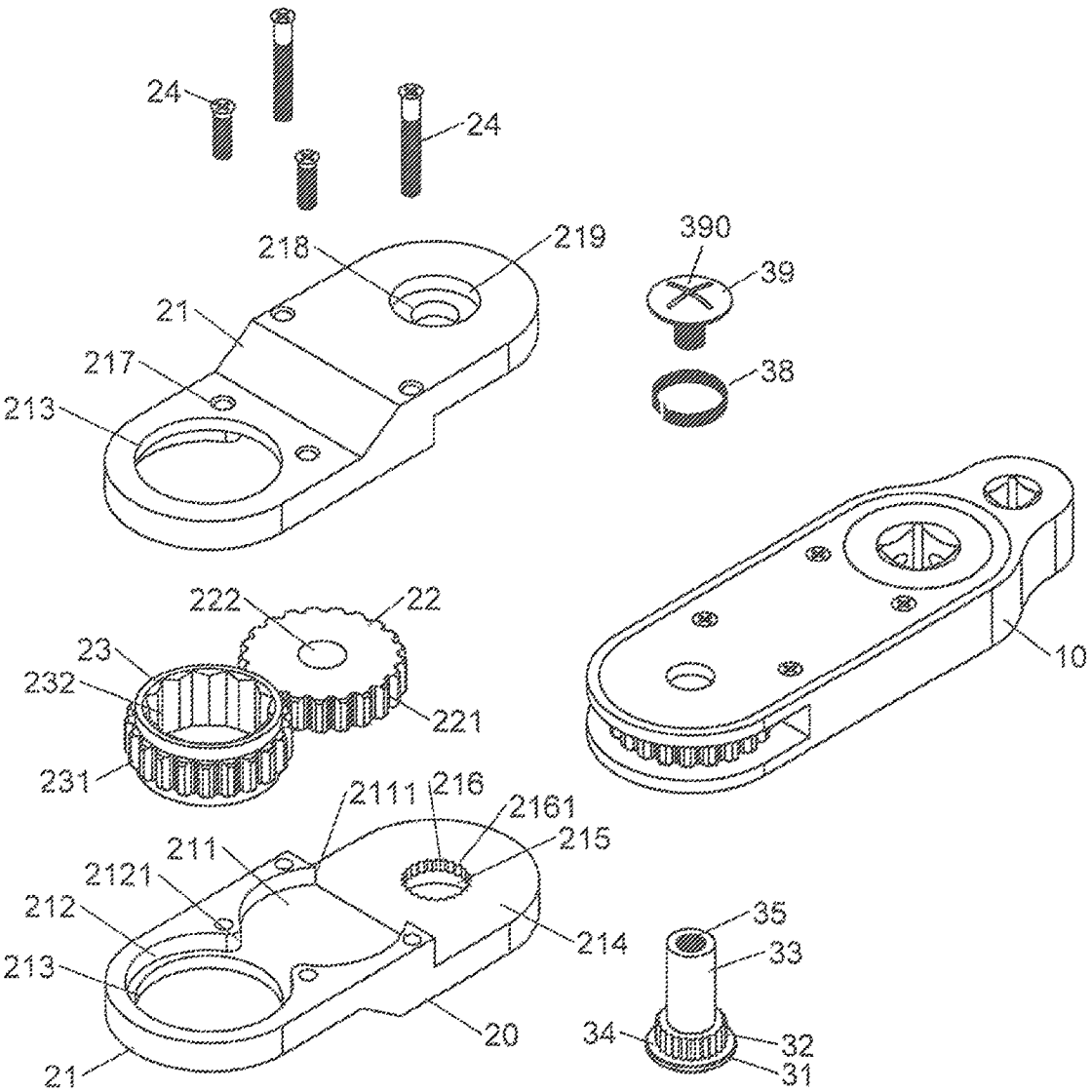
FIG. 14 is a perspective view to show the second embodiment of the attachment assembly of the present invention.
Figure 15:
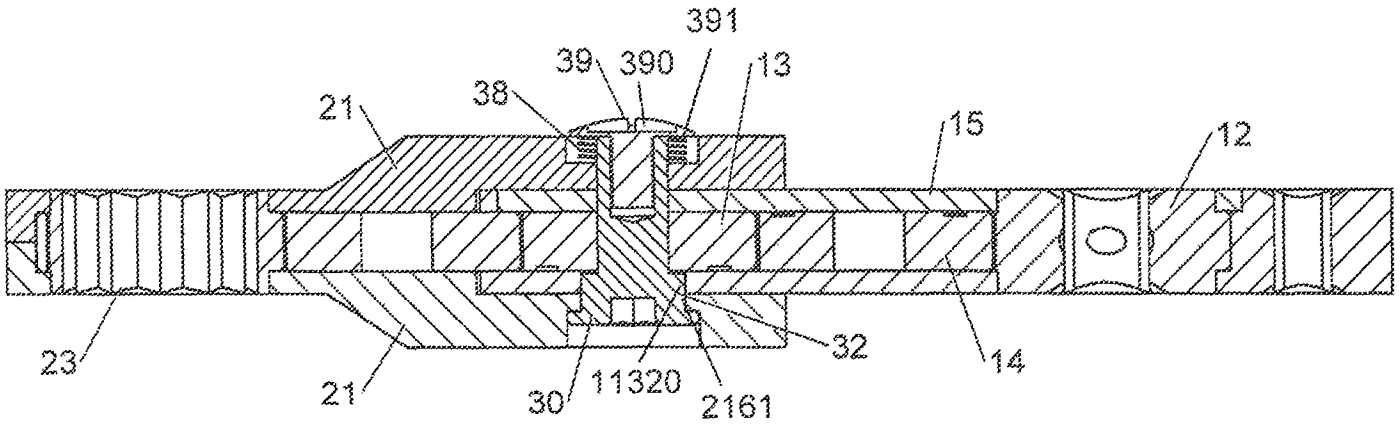
FIG. 15 is a cross sectional view of the second embodiment of the present invention.

Referring to FIGS. 1, 7, 8, 9, 14 and 15, when the switching shaft 30 is supported by the spring 38 to position at the first position, the third engaging teeth 32 simultaneously engage with the second engaging teeth 2161 and the first engaging teeth 11320, the active unit 10 and the passive unit 20 cannot be rotated with respect to each other. When the user provides a force to press the head 31 of the switching shaft 30 so that the switching shaft 30 move from the first position to the second position and compress the spring 38 to have an elastic force, and the third engaging teeth 32 does not engage with the second engaging teeth 2161 but only engage with the first engaging teeth 11320, the active unit 10 and the passive unit 20 can be rotated with respect to each other. Referring to FIGS. 1, 7 and 8, in one embodiment of the present invention, the spring 38 is positioned in the enlarged circular recess 215 and bias between the bottom of the enlarged circular recess 215 and end face 34 of the head 31 of the switching shaft 30, and top end portions of the third engaging teeth 32 are received in the enlarged receiving hole 133 when the switching shaft 30 is positioned at the second position. Referring to FIGS. 14 and 15, in another embodiment of the present invention, the spring 38 is positioned in the enlarged circular recess 219 and bias between the bottom of enlarged circular recess 219 and the end face 391 of the head 390 of the screw 39.

As shown in FIGS. 1, 2, 10 and 13, when the users want to pick out the bolt 51 at the object 52, because there is a distance 54 between the two objects 53, the active and passive units 10, 20 can be adjusted an angle so that the passive unit 20 is inserted into the distance to be mounted to the bolt 51. The engaging portion 232 is mounted to the bolt 51, and the two hand tools 40, 41 are respectively connected with the engaging portion 122 and the first mounting hole 114. When rotating the hand tool 40, the front wheel 12 drives the middle wheel 14, the rear wheel 13, the first wheel 22 and the second wheel 23. The bolt 51 is able to be rotated and picked out from the object 52.

Figure 11:
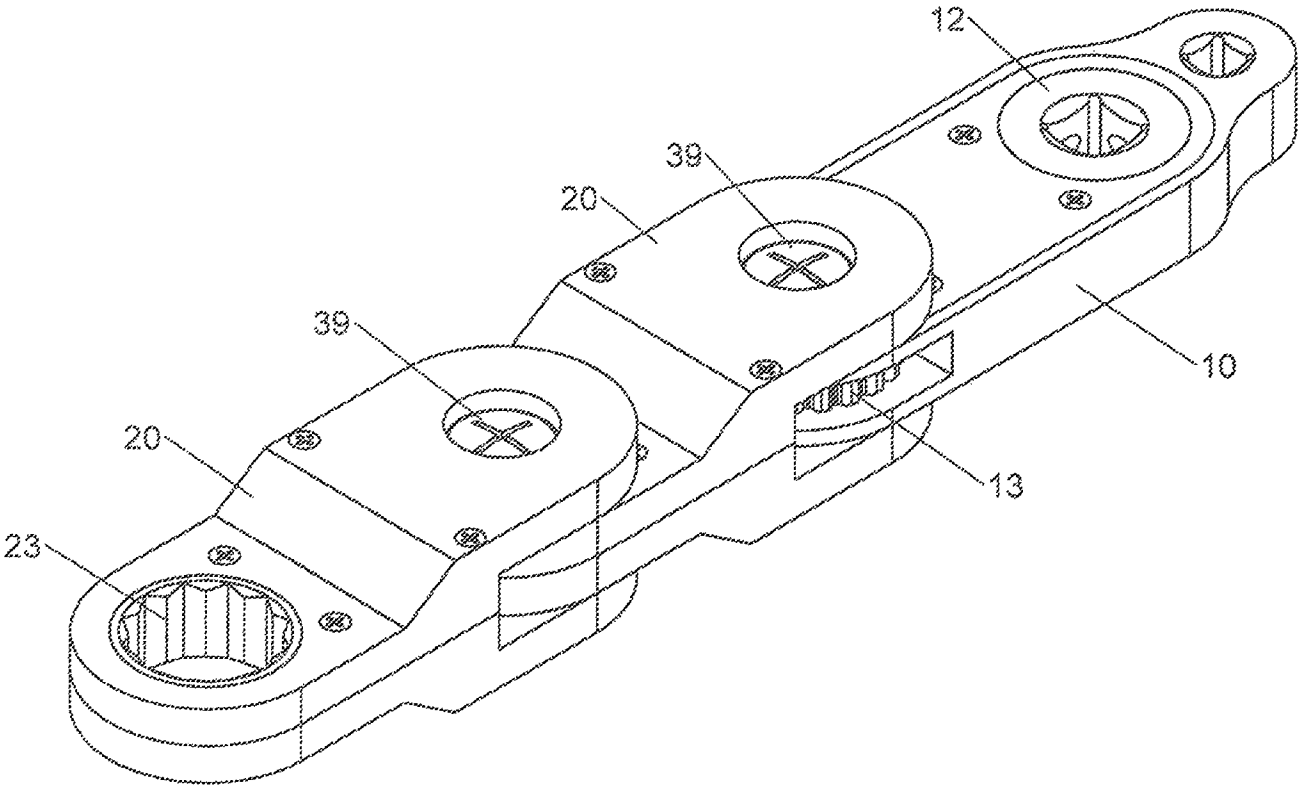
FIG. 11 is a perspective view to show two passive units of the attachment assembly of the present invention connecting together.
Figure 12:
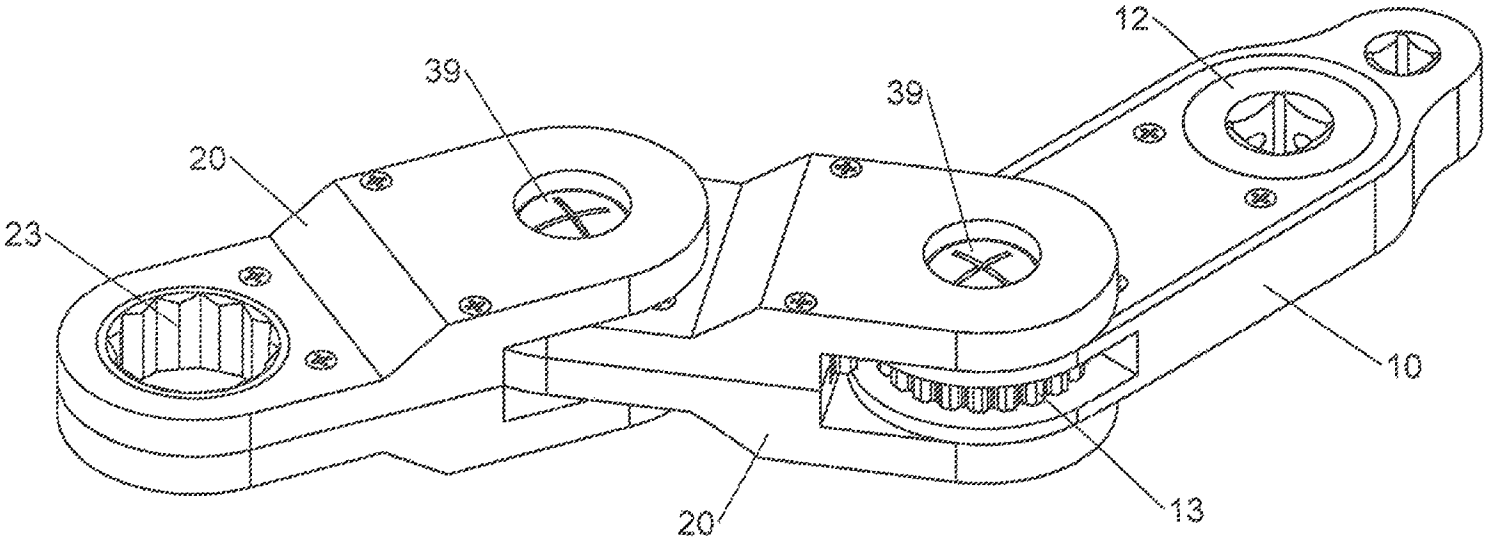
FIG. 12 is a perspective view to show the active unit and two passive units of the attachment assembly of the present invention connecting together and having an inclined angle respectively.
Figure 13:
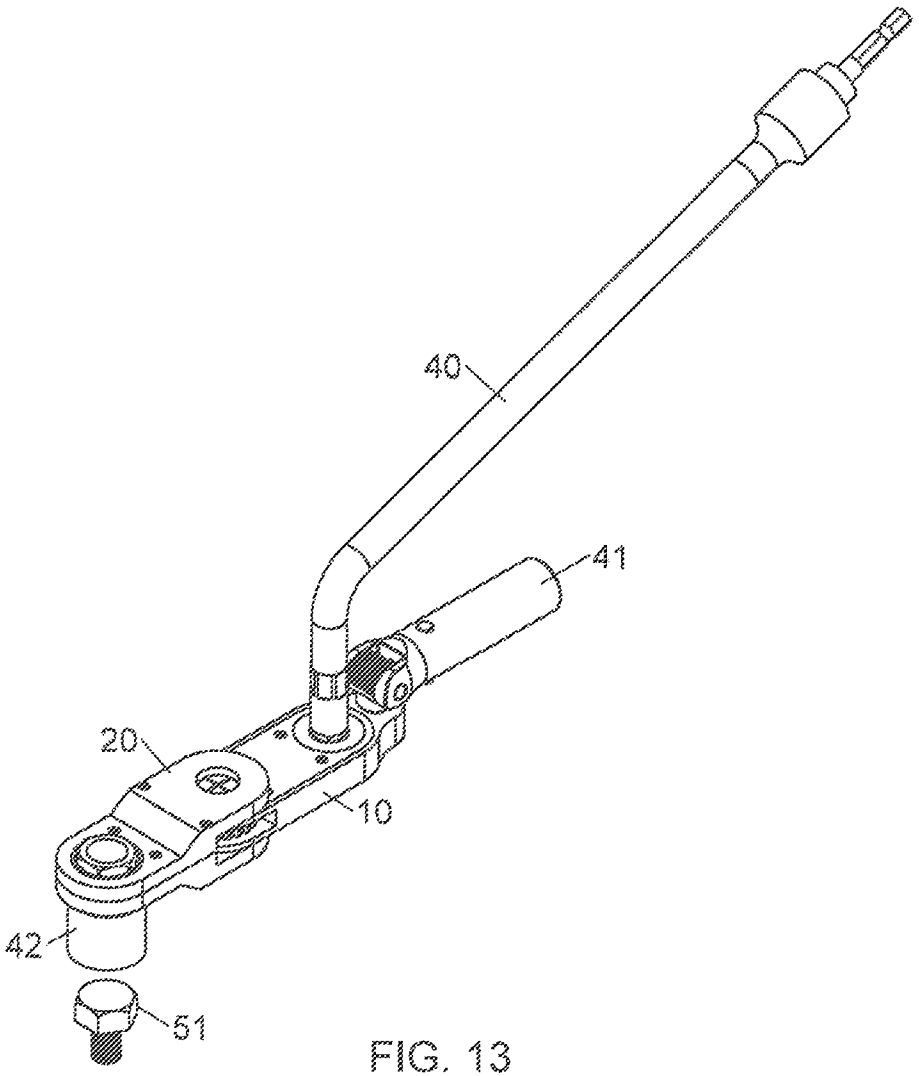
FIG. 13 shows the attachment assembly of the present invention being cooperated with two hand tools and connected with a workpiece.

As shown in FIGS. 11 and 12, there are two passive units 20. The second wheel 23 of one of the two passive units 20 is located in the recessed area 214 of the other one of the two passive units 20. A pin 300 extends through the engaging portion 232 of the second wheel 23 and the recessed area 214 to connect the two passive units 20.

Figure 2:
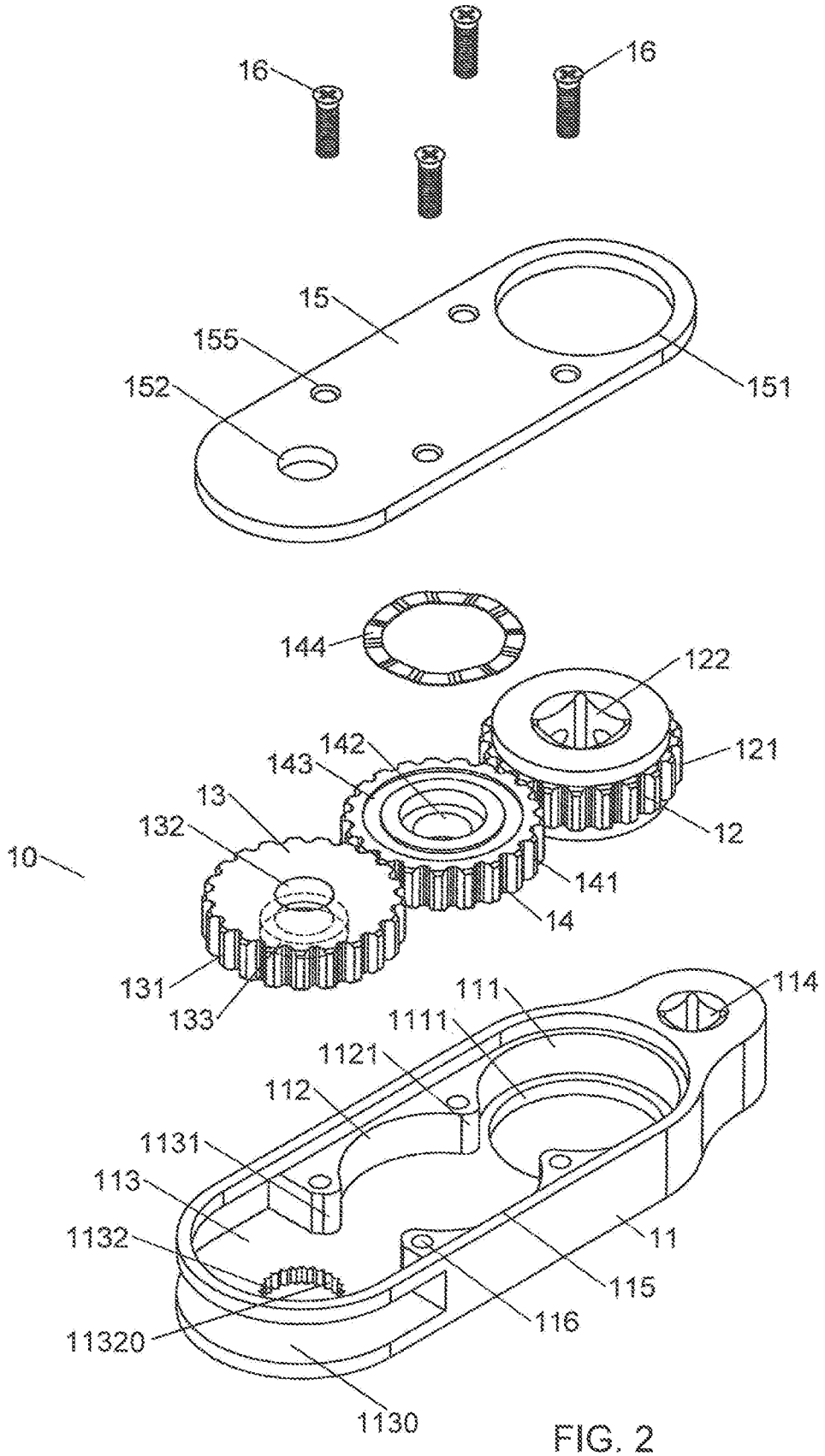
FIG. 2 is an exploded view of the active unit of the attachment assembly of the present invention.
Figure 3:
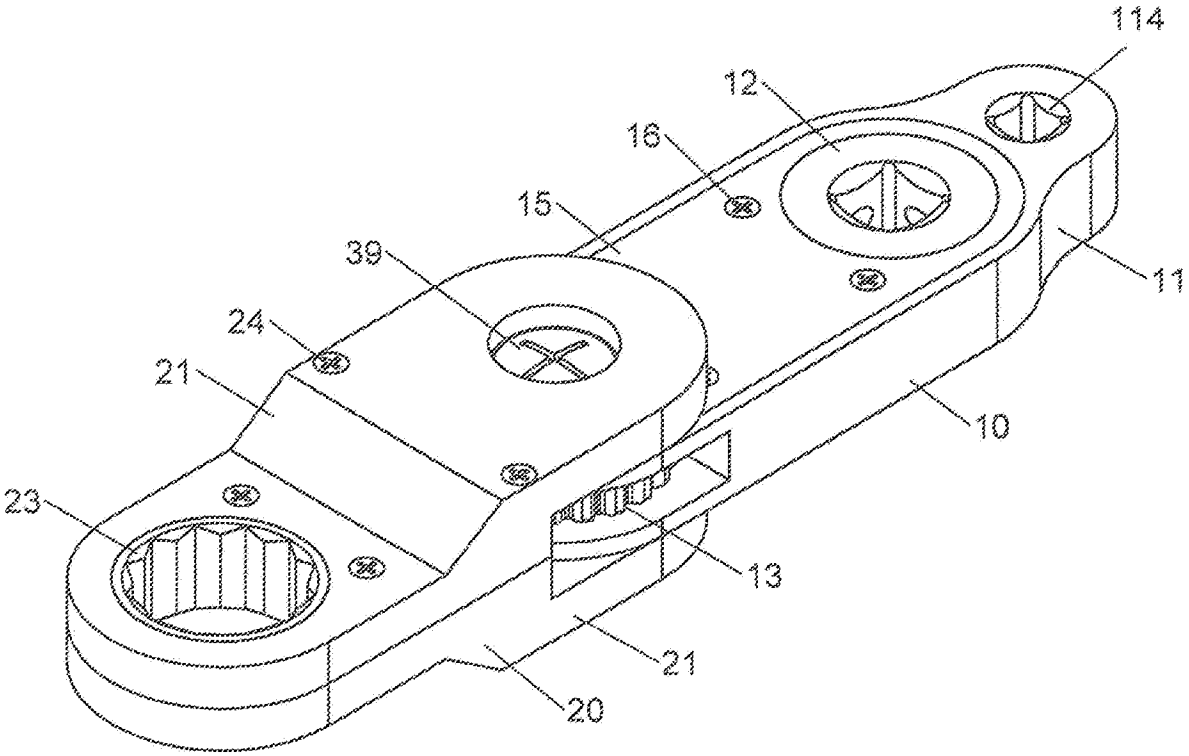
FIG. 3 is a perspective view to show the attachment assembly of the present invention.

As shown in FIGS. 1 and 2, the second base 21 and the second cover 210 have same shapes of recessed area 214, first recess 211, second recess 212 coaxially bore 213, third opening 2111 and fourth opening 2121. The second base 21 and the second cover 210 cover with each other and receive the first and second wheels 22, 23 in the first and second recesses 211/212.

Figure 4:
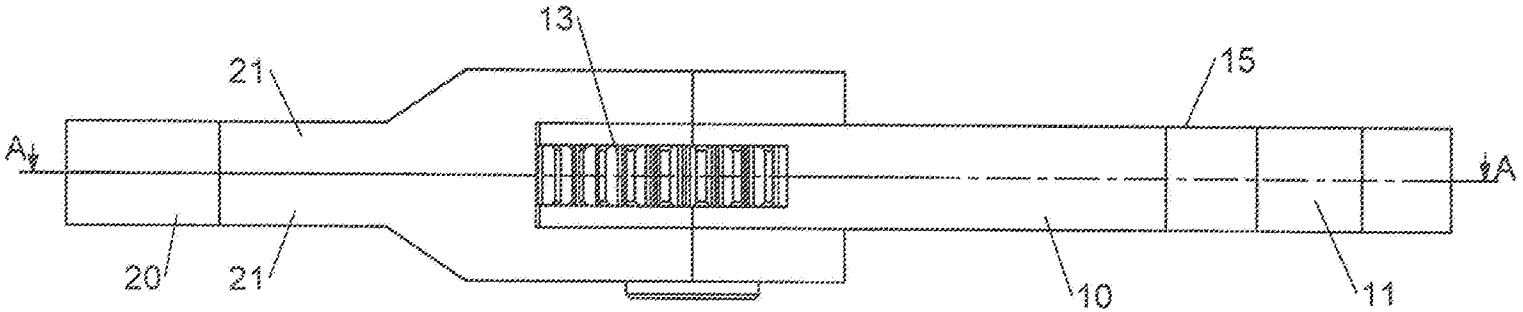
FIG. 4 is a side view to show the attachment assembly of the present invention.
Figure 5:
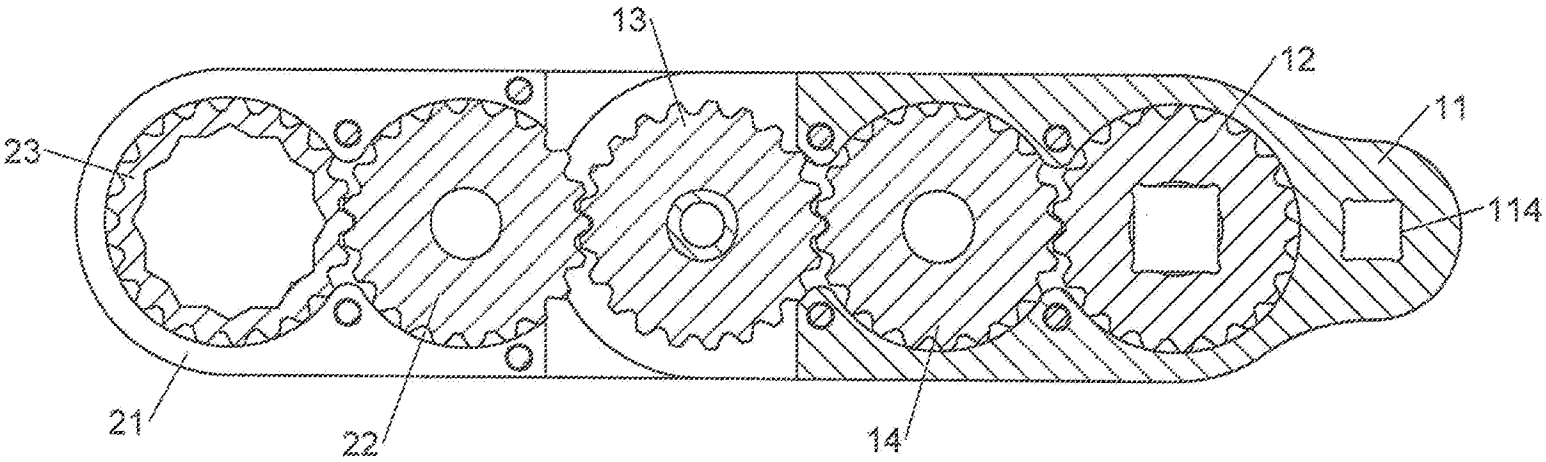
FIG. 5 is a cross sectional view, taken along line A-A of FIG. 4.
Figure 6:
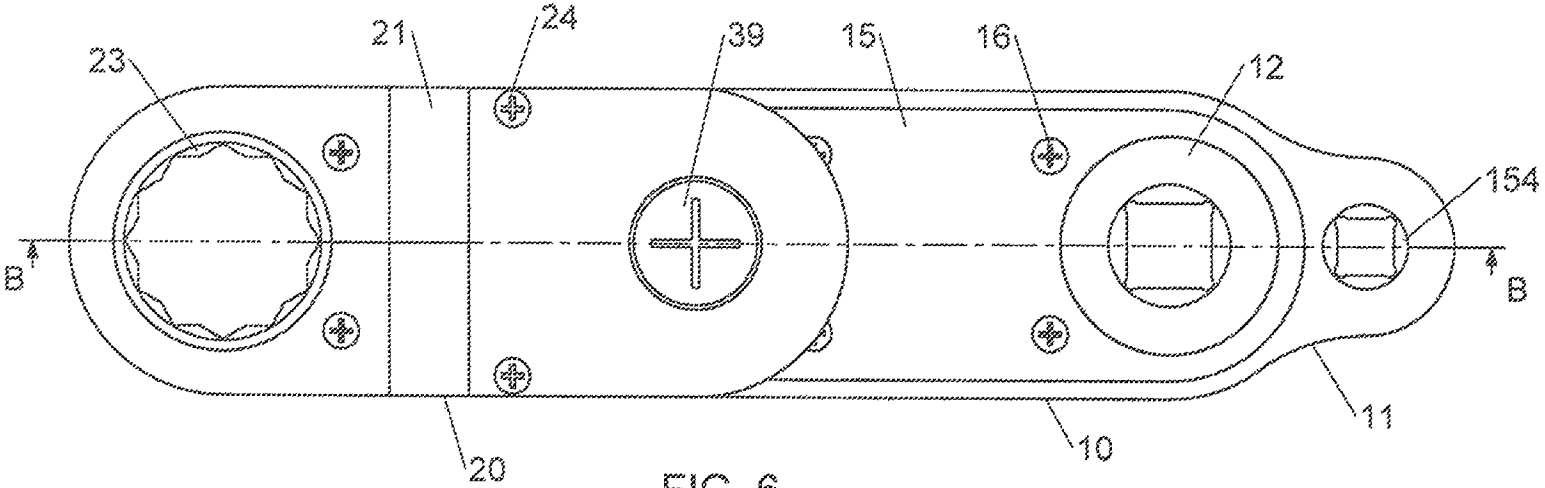
FIG. 6 shows is a top view to show the attachment assembly of the present invention.
Figure 10:
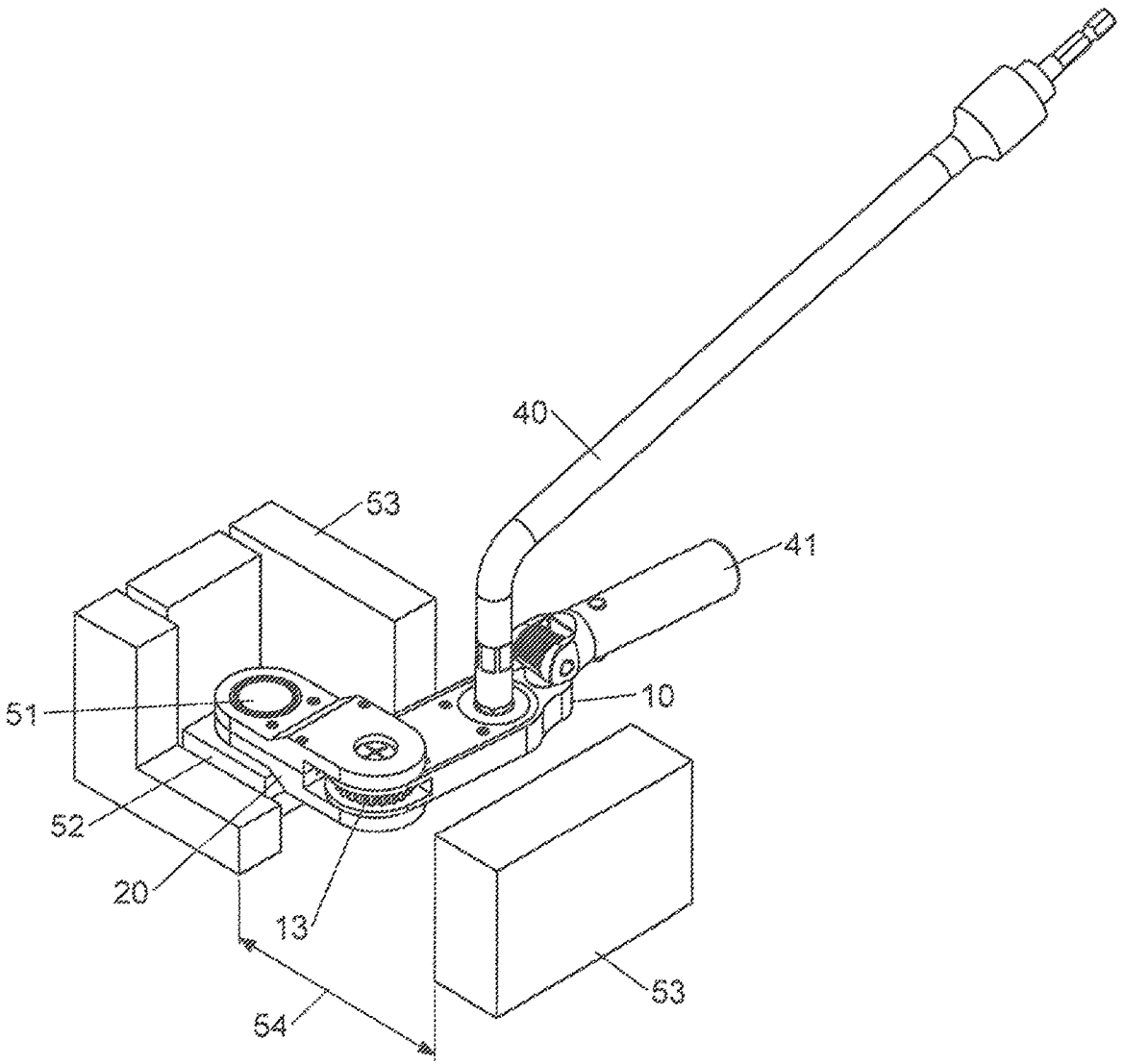
FIG. 10 shows the attachment assembly of the present invention being cooperated with two hand tools.

The advantages of the present invention are that the active and passive units 10, 20 are pivotably connected to each other. The front wheel 12, the middle wheel 14, the rear wheel 13, the first wheel 22 and the second wheel 23 are co-rotated. Therefore, the operational status can be easily adjusted to meet different work tasks as shown in FIGS. 4 and 5. The attachment assembly can be cooperated with two hand tools 40, 41 as shown in FIG. 10, the users can easily grip the hand tools 40, 41 to output torques. As shown in FIGS. 11 and 12, there can be cooperated with multiple passive units 20 to extend the length of the combination of the attachment assemblies, and multiple angles can be set to deal with different work requirements. As shown in FIGS. 7, 8 and 15 especially, the switching shaft 30 is axially movable to switch rotatable status and un-rotatable status between the active unit 10 and the passive unit 20.

While we have shown and described the embodiment in accordance with the present invention, it should be clear to those skilled in the art that further embodiments may be made without departing from the scope of the present invention.

What is claimed is:

1. An attachment assembly for being connected with a hand tool, comprising:

an active unit having a first base and a first cover which is mounted to the first base; a front wheel, a middle wheel and a rear wheel being rotatably received in a space between the first base and the first cover in sequence; outer teeth of the middle wheel being respectively engaged with outer teeth of the front wheel and the rear wheel so that the front wheel, the middle wheel and the rear wheel can rotate simultaneously; a rear recess being defined in a rear portion of the first base; the rear recess having a rear pivotal hole defined through a bottom thereof; a polygonal first engaging portion defined centrally in the front wheel for connecting a workpiece; the rear wheel having an axial hole defined centrally therethrough; wherein multiple first engaging teeth being defined on the inner periphery of the rear pivotal hole;

at least one passive unit including a second base and a second cover which is mounted to the second base, a first wheel and a second wheel rotatably received in a space between the second base and the second cover; a second engaging portion defined centrally in the second wheel for connecting a workpiece; outer teeth of the first wheel being respectively engaged with outer teeth of the second wheel and the outer teeth of the rear wheel so that the front wheel, the middle wheel, the rear wheel, the first wheel and the second wheel can rotate simultaneously; the second base having a recessed area defined therein; the rear end of the first base being rotatably located in the recessed area; the recessed area having a first bore defined through a bottom thereof; wherein multiple second engaging teeth being defined on inner periphery of the first bore; the second cover having a second bore corresponding to the first bore;

a switching shaft movably extending through the first bore, the second bore and the axial hole; multiple third engaging teeth being defined on a middle portion of the switching shaft; the multiple third engaging teeth being configured for a first engagement configuration with the multiple second engaging teeth and the multiple first engaging teeth simultaneously, and for a second engagement configuration with the multiple first engaging teeth only; and a spring being mounted on the switching shaft for providing an elastic force for the switching shaft so that the switching shaft can axially move back from a second position to a first position; wherein when the switching shaft is supported by the spring to position at the first position, the multiple third engaging teeth simultaneously engage with the multiple second engaging teeth and the multiple first engaging teeth, the active unit and the passive unit cannot be rotated with respect to each other; wherein the switching shaft is configured to move from the first position to the second position and compress the spring elastically, and the multiple third engaging teeth does not simultaneously engage with the multiple second engaging teeth and the multiple first engaging teeth, the active unit and the passive unit can be rotated about the switching shaft with respect to each other.

2. The attachment assembly as claimed in claim 1, wherein the multiple first engaging teeth have 10-20 teeth.

3. The attachment assembly as claimed in claim 1, wherein the multiple first engaging teeth, the multiple second engaging teeth and the multiple third engaging teeth have 10-20 teeth respectively.

4. The attachment assembly as claimed in claim 1, wherein the spring is positioned in a first enlarged recess which is defined in a bottom portion of the first bore and biased between a bottom of the first enlarged recess and an end face of a head which is defined on a first end of the switching shaft.

5. The attachment assembly as claimed in claim 4, wherein an enlarged receiving hole is defined in a bottom portion of the axial hole; when the switching shaft is positioned at the second position, top end portions of the third engaging teeth are received in the enlarged receiving hole.

6. The attachment assembly as claimed in claim 1, wherein the spring is positioned in a second enlarged recess which is defined in a top portion of the second bore and biased between a bottom of second enlarged recess and an end face of a head of a screw which is connected to a second end of the switching shaft.

7. The attachment assembly as claimed in claim 1, wherein a first mounting hole is defined through a front end of the first base; the polygonal first engaging portion and the first mounting hole have the same specification.

8. The attachment assembly as claimed in claim 1, wherein a lateral slot defined from a lateral wall of the rear recess and through a rear end of the first base; the teeth of the rear wheel engage with the teeth of the first wheel through the lateral slot.

9. The attachment assembly as claimed in claim 1, wherein the middle wheel includes an annular groove which is defined at one end of the middle wheel and around an axial of the middle wheel; a ring-shaped resilient member is mounted in the annular groove and against the middle wheel and the first cover so as to provide a resistance for the middle wheel when rotates.

10. The attachment assembly as claimed in claim 1, wherein the second cover is the same shape as the second base.

11. The attachment assembly as claimed in claim 1, wherein the second base and the second cover are connected to each other by multiple rivets.

12. The attachment assembly as claimed in claim 1, wherein the second engaging portion of the second wheel is a polygonal recess or a rectangular protrusion.

* * * * *